US009607794B2

(12) United States Patent
Jang

(10) Patent No.: US 9,607,794 B2
(45) Date of Patent: Mar. 28, 2017

(54) MOLDED CIRCUIT BREAKER CASE WITH EXHAUST GUIDE AND COVER

(71) Applicant: LSIS CO., LTD., Anyang-si, Gyeonggi-do (KR)

(72) Inventor: Bong Yun Jang, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 308 days.

(21) Appl. No.: 14/447,493

(22) Filed: Jul. 30, 2014

(65) Prior Publication Data

US 2015/0129555 A1 May 14, 2015

(30) Foreign Application Priority Data

Nov. 8, 2013 (KR) ..... 10-2013-0135800

(51) Int. Cl.

| | |
|---|---|
| ***H01H 9/02*** | (2006.01) |
| ***H01H 33/53*** | (2006.01) |
| ***H01H 9/04*** | (2006.01) |
| ***H01H 9/34*** | (2006.01) |
| ***H01H 71/02*** | (2006.01) |

(52) U.S. Cl.

CPC ..... *H01H 33/53* (2013.01); *H01H 9/04* (2013.01); *H01H 9/342* (2013.01); *H01H 71/02* (2013.01)

(58) Field of Classification Search

CPC ..... H01H 9/342; H01H 9/343; H01H 9/345; H01H 9/346; H01H 9/347; H01H 9/30

USPC ..... 200/306; 218/34, 35, 149, 156, 157; 335/201

See application file for complete search history.

(56) References Cited

U.S. PATENT DOCUMENTS

| | | | |
|---|---|---|---|
| 4,928,080 | A | 5/1990 | Jacobs et al. |
| 5,150,091 | A | 9/1992 | Hart et al. |

(Continued)

FOREIGN PATENT DOCUMENTS

| | | |
|---|---|---|
| CN | 86107135 | 4/1987 |
| CN | 101252048 | 8/2008 |

(Continued)

OTHER PUBLICATIONS

The State Intellectual Property Office of the People's Republic of China Application Serial No. 201410610721.4, Office Action dated Apr. 1, 2016, 6 pages.

(Continued)

*Primary Examiner* — Vanessa Girardi

(74) *Attorney, Agent, or Firm* — Lee, Hong, Degerman, Kang & Waimey PC

(57) ABSTRACT

A molded case circuit breaker (MCCB) includes a case, an interrupter assembly, an exhaust guide part, an exhaust cover, a sealing groove and a sealing projection. The interrupter assembly is mounted inside the case, and has an arc gas exhaust port to exhaust an arc gas generated inside the case. The exhaust guide part is disposed between the interrupter assembly and the terminal part, and has an exhaust chamber therein to provide an arc gas passage between the arc gas exhaust port and a vent chute of the terminal part. The exhaust cover is mounted to the case in a structure covering the exhaust guide part, to seal the arc gas passage. The sealing groove is formed in an inner surface of the exhaust cover. The sealing projection is formed on the arc gas exhaust port of the interrupter assembly, to be inserted and coupled into the sealing groove.

3 Claims, 10 Drawing Sheets

(56) References Cited

U.S. PATENT DOCUMENTS

| | | | | |
|---|---|---|---|---|
| 5,811,749 | A | 9/1998 | Bausch et al. | |
| 7,034,241 | B2 * | 4/2006 | Fleege | H01H 9/342 218/157 |
| 9,362,065 | B2 * | 6/2016 | Jang | H01H 9/047 |
| 9,373,469 | B2 * | 6/2016 | Jang | H01H 33/022 |

FOREIGN PATENT DOCUMENTS

| | | |
|---|---|---|
| JP | 09-507722 | 8/1997 |
| JP | 11-242924 | 9/1999 |
| JP | 2010-219033 | 9/2010 |
| KR | 10-2004-0000826 | 1/2004 |
| KR | 20-2012-0008674 | 12/2012 |
| KR | 10-1297515 | 8/2013 |

OTHER PUBLICATIONS

Japan Patent Office Application Serial No. 2014-173430, Office Action dated Jan. 5, 2016, 4 pages.
Korean Intellectual Property Office Application Serial No. 10-2013-0135800, Notice of Allowance dated Mar. 23, 2015, 2 pages.
European Patent Office Application Serial No. 14179272.1, Search Report dated Mar. 27, 2015, 7 pages.
Japan Patent Office Application Serial No. 2014-173430, Office Action dated May 1, 2015, 2 pages.

* cited by examiner

MOLDED CIRCUIT BREAKER CASE WITH EXHAUST GUIDE AND COVER

CROSS-REFERENCE TO RELATED APPLICATIONS

Pursuant to 35 U.S.C. §119(a), this application claims the benefit of earlier filing date and right of priority to Korean Application No. 10-2013-0135800, filed on Nov. 8, 2013, the contents of which are all hereby incorporated by reference herein in its entirety.

BACKGROUND OF THE INVENTION

1. Field of the Invention

The present disclosure relates to a molded case circuit breaker capable of preventing insulation breakdown caused by leakage of an arc gas generated when a short circuit occurs.

2. Description of the Conventional Art

In general, a molded case circuit breaker (MCCB) is one obtained by integrally assembling an opening/closing mechanism, a trip device and the like in a container of an insulating material. The MCCB is typically a mechanism which enables an electric path in a use state to be opened/closed manually or by an electricity control device at an exterior of the insulating container, and automatically cuts off the electric path when an overload, short circuit or the like occurs.

For example, when a short circuit between lines occurs, the trip device installed in the MCCB separates a contact point, thereby cutting off the electric path. When the contact point is separated, an arc is generated, and an arc gas in a plasma state is exhausted to the exterior of the MCCB through an arc gas vent means provided in the MCCB.

FIG. 1 is a perspective view illustrating a conventional vent means for a circuit breaker according to prior U.S. Pat. No. 7,034,241. In the conventional vent means, an arc gas generated inside an interrupter assembly 70 is exhausted to a chamber area 100 through an exhaust pipe 80 at a lower end of the interrupter assembly 70. The arc gas is divided to both sides through a triangular gas division part 110 in the chamber area 100 and then exhausted to the exterior of the MCCB through a chute 90.

However, in the conventional arc gas exhaust structure according to prior U.S. Pat. No. 7,034,241, as an arc is leaked through a gap formed when a case 190 and the interrupter assembly 70 are coupled to each other, the arc is leaked to the upper end surface of the triangular gas division part 110 provided on the bottom surface of the case 190, and dust generated by the arc is absorbed on the conductor surface of a trip part, thereby forming a conduction path. Therefore, insulation between internal conductors and insulation between the internal conductor and the bottom surface (ground) of the case 190 are broken down. Accordingly, there is a problem in that an internal force with respect to a reference internal voltage of 2.2 kV is lost.

SUMMARY OF THE INVENTION

Therefore, an aspect of the detailed description is to provide a molded case circuit breaker (MCCB) having an integrated sealing structure, in which an arc gas exhausted through an exhaust port of an interrupter assembly is not leaked through a gap formed when a case and the interrupter assembly are coupled to each other, but can be quickly exhausted to the exterior.

To achieve these and other advantages and in accordance with the purpose of this specification, as embodied and broadly described herein, an MCCB includes: a case, an interrupter assembly, an exhaust guide part and an exhaust cover.

In one exemplary embodiment, the case may have a line side terminal part and a load side terminal part, to which a line side external terminal and a load side external terminal are respectively connected.

In one exemplary embodiment, the interrupter assembly may be mounted inside the case, and have an arc gas exhaust port to exhaust an arc gas generated inside the case.

In one exemplary embodiment, the exhaust guide part may be disposed between the interrupter assembly and the terminal part, and have an exhaust chamber therein to provide an arc gas passage between the arc gas exhaust port and a vent chute of the terminal part.

In one exemplary embodiment, the exhaust cover may be mounted to the case in a structure covering the exhaust guide part, to seal the arc gas passage.

In one exemplary embodiment, a sealing groove may be formed in an inner surface of the exhaust cover, and a sealing projection may be formed on the arc gas exhaust port of the interrupter assembly, to be inserted and coupled into the sealing groove.

Accordingly, the sealing projection is formed on the arc gas exhaust port of the interrupter assembly, so that it is possible to prevent the arc gas from being leaked through a gap formed when the case and the interrupter assembly are coupled to each other.

In one exemplary embodiment, the interrupter assembly may include a housing configured to have the arc gas exhaust port on at least one end thereof; and sealing maintenance grooves respectively formed adjacent to the are gas exhaust port at both side surfaces of the housing.

In one exemplary embodiment, a sealing maintenance projection may be formed on an inner surface of the case, to be engageably coupled to the sealing maintenance groove.

In one exemplary embodiment, the exhaust cover may include land parts formed in the inner surface thereof while being spaced apart from each other with the sealing groove interposed therebetween, to be overlapped with the sealing projection.

In one exemplary embodiment, the sealing projection may be formed opposite to the exhaust cover throughout another corner from one corner along the circumferential surface of the arc gas exhaust port.

In one exemplary embodiment, the interrupter assembly may further include coupling grooves respectively formed round at the corners along the circumferential surface of the arc gas exhaust port.

In one exemplary embodiment, the exhaust cover may include side protruding parts and a coupling part.

In one exemplary embodiment, the side protruding parts may be protruded from both end portions of the land parts, to connect the land parts.

In one exemplary embodiment, the coupling part may be formed round at a connecting portion between the side protruding part and the land part, to be coupled to the coupling groove while surrounding the coupling groove.

As described above, in the MCCB of the present invention, the arc gas exhausted through the arc gas exhaust port of the interrupter assembly is not leaked through a gap formed when the case and the interrupter assembly are coupled to each other, but can be quickly exhausted to the exterior.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWING

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF EXEMPLARY EMBODIMENTS

Description will now be given in detail of the exemplary embodiments, with reference to the accompanying drawings. For the sake of brief description with reference to the drawings, the same or equivalent components will be provided with the same reference numbers, and description thereof will not be repeated.

The present invention provides a sealing structure for preventing leakage of an arc gas generated in a short circuit between lines in a molded case circuit breaker (MCCB).

Particularly, the present invention provides a sealing structure for sealing a gap formed between a case and a housing of an interrupter assembly in an MCCB.

Figure 1:
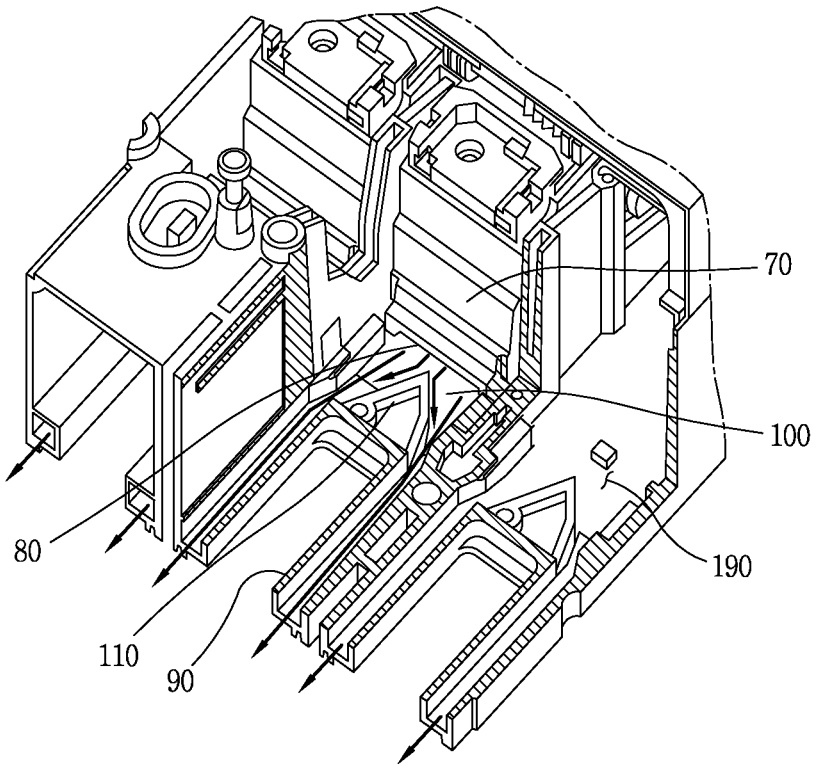
FIG. 1 PRIOR ART
FIG. 1 is a perspective view illustrating a conventional vent means for a circuit breaker according to prior U.S. Pat. No. 7,034,241.
Figure 2:
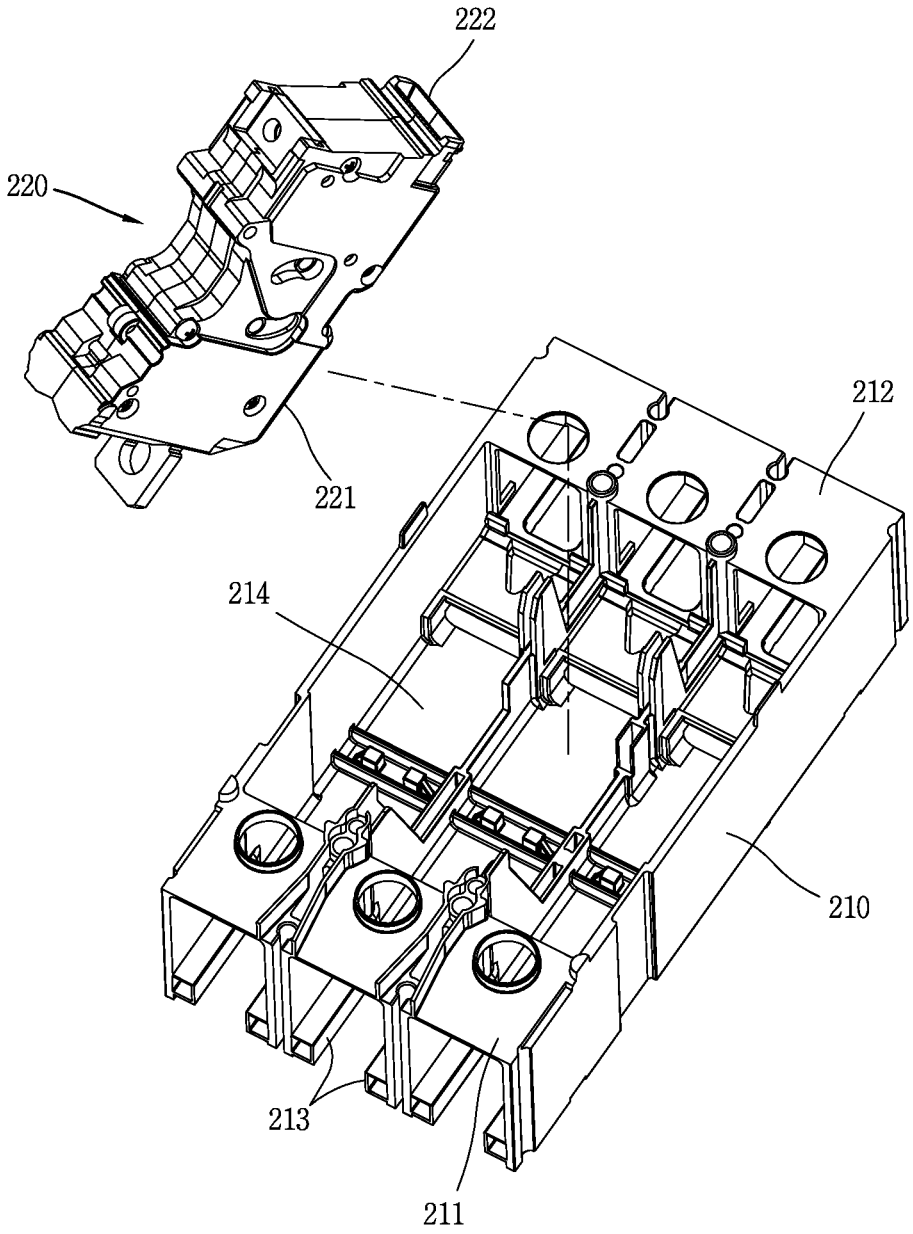
FIG. 2 is an exploded perspective view illustrating a case and an interrupter assembly in a molded case circuit breaker (MCCB) according to an exemplary embodiment.
Figure 3:
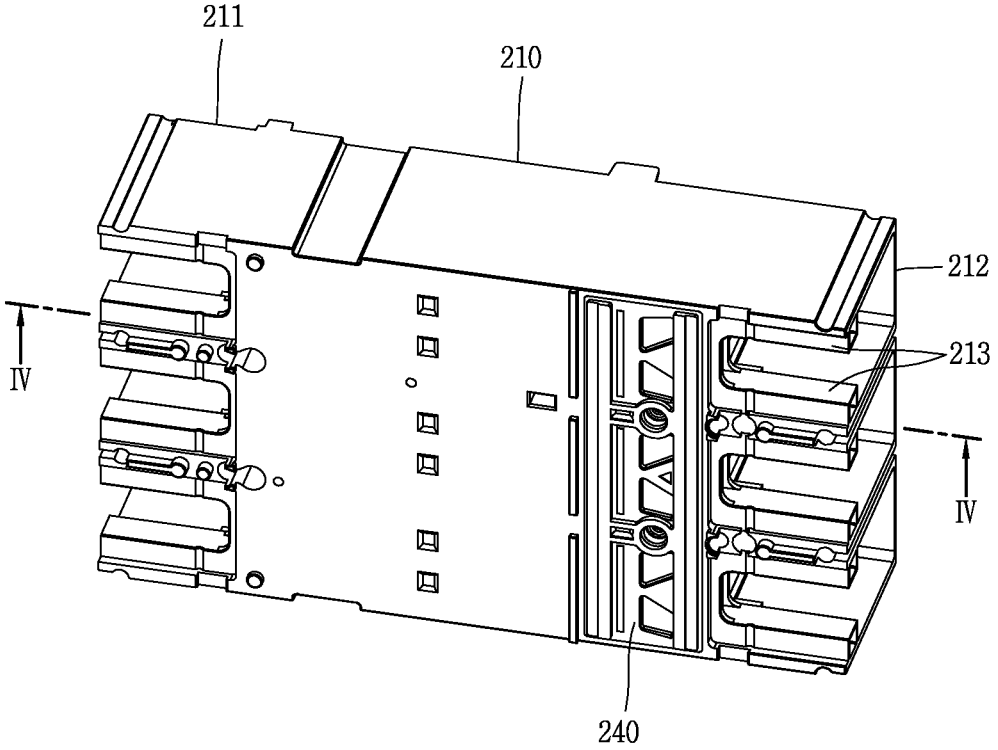
FIG. 3 is a bottom perspective view of the case according to the exemplary embodiment.
Figure 4:
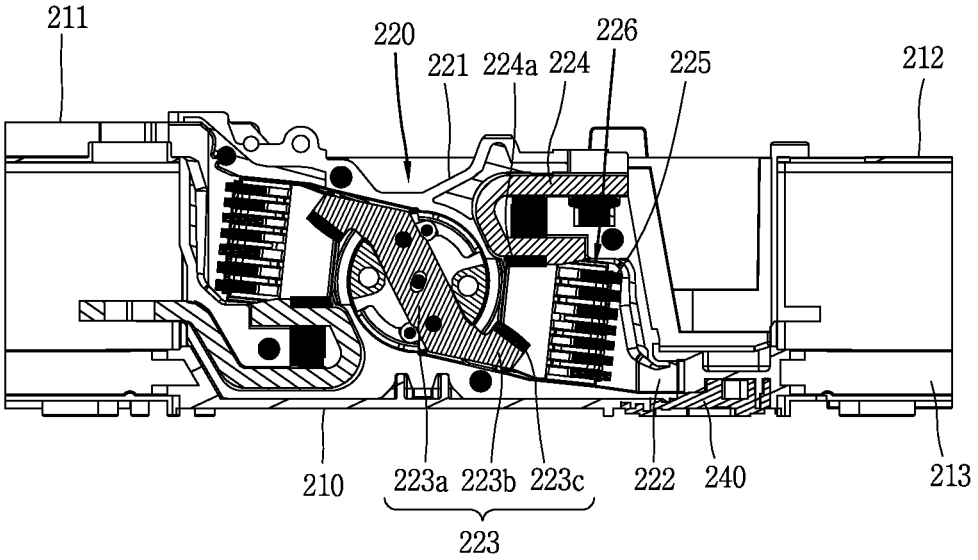
FIG. 4 is a sectional view taken along line IV-IV in FIG. 3.

FIG. 2 is an exploded perspective view illustrating a case and an interrupter assembly in an MCCB according to an exemplary embodiment. FIG. 3 is a bottom perspective view of the case according to the exemplary embodiment. FIG. 4 is a sectional view taken along line IV-IV in FIG. 3.

The MCCB according to the exemplary embodiment includes a case 210, an interrupter assembly 220, and an arc gas exhaust system.

The MCCB according to the exemplary embodiment may be configured with power sources (lines) of R, S and T phases, i.e., a three-phase three-line type.

The case 210 may be divided into an upper case and a lower case 210, which maintain the external shape and framework of a product. The upper case has a handle for manually manipulating on/off of the MCCB, and is positioned at an upper portion of the case 210 to act as a cover. The lower case 210 accommodates the interrupter assembly 220 and internal components including a trip part and the like, and is positioned at a lower portion of the case 210 to act as a main body.

Particularly, the lower case 210 is formed in a box-shaped structure in which the length of a side surface in one direction is longer than that of a side surface in another direction. When the direction in which the length is long is referred to as a length direction and the direction in which the length is short is referred to as a width direction, a power source side terminal port 211 and a load side terminal part 212 are respectively provided at both end portions of the lower case 210 in the length direction, to connect a power source and a load. In this state, each of the power source side terminal part 211 and the load side terminal part 212 is closed in all directions but opened in the length direction.

An internal space 214 for accommodating the interrupter assembly 220 is provided between the power source side terminal part 211 and the load side terminal part 212. The internal space 214 is partitioned for each phase by partition walls formed long in the length direction at a distance in the width direction. The internal space 214 independently connects or disconnects each power source to a load side. In this state, the upper surface of the internal space 214 is opened.

The interrupter assembly 220 is provided for each of the three phases. The interrupter assemblies 220 are respectively inserted and assembled in the internal spaces 214 separately partitioned, thereby performing a function of opening/closing contact points between the phases.

The interrupter assembly 220 includes a housing 221 partitioned to be symmetrical in the left and right directions about the center line in the length direction, movable and fixed platforms 223 and 224 provided inside the housing 221, and extinguishing parts 226 for extinguishing an arc.

The fixed platforms 224 are disposed and fixed in a diagonal direction inside the housing 221, and a fixed contact point 224*a* is fixedly mounted at one end portion of each fixed platform 224. In this state, the fixed contact point 224*a* is positioned within a rotational radius range of a movable contact point 223*c* provided to the movable platform 223.

The movable platform 223 may be configured with a movable platform body 223*a* of which central portion is rotatably coupled in a hinge structure to a shaft positioned at the central portion of the housing 221, movable platform arm parts 223*b* extended long in the opposite directions to each other from the movable platform body 223*a*, and the movable contact points 223*c* respectively provided at ends of the movable platform arm parts 223*b*. In this state, the movable contact point 223*c* is interlocked with the rotation of the movable platform 223, to be contacted or separated with or from the fixed contact point 224*a*.

Each extinguishing part 226 has a plurality of grids 225 disposed to be spaced apart from each other in the rotational direction of the movable platform 223 distant from the fixed platform 224. The extinguishing parts 226 are positioned in a diagonal direction to be adjacent to the respective fixed contact points 224*a* of the fixed platforms 224 inside the housing 221, thereby extinguishing (quenching) an arc generated between the movable contact point 223*c* and the fixed contact point 224*a*. The grids 225 can extinguish an arc by inducing the arc to enter into a gap therebetween and cutting the arc or extending the arc to an end of the grid 225.

Figure 5:
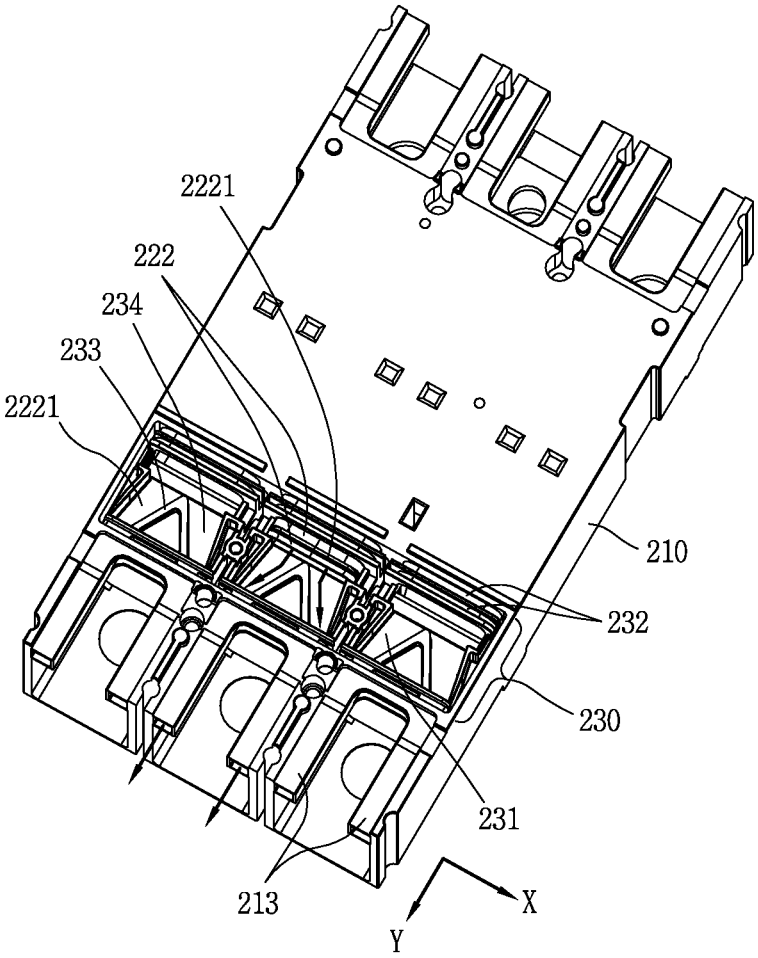
FIG. 5 is a bottom perspective view illustrating a state in which an exhaust cover is separated in FIG. 3.
Figure 6:
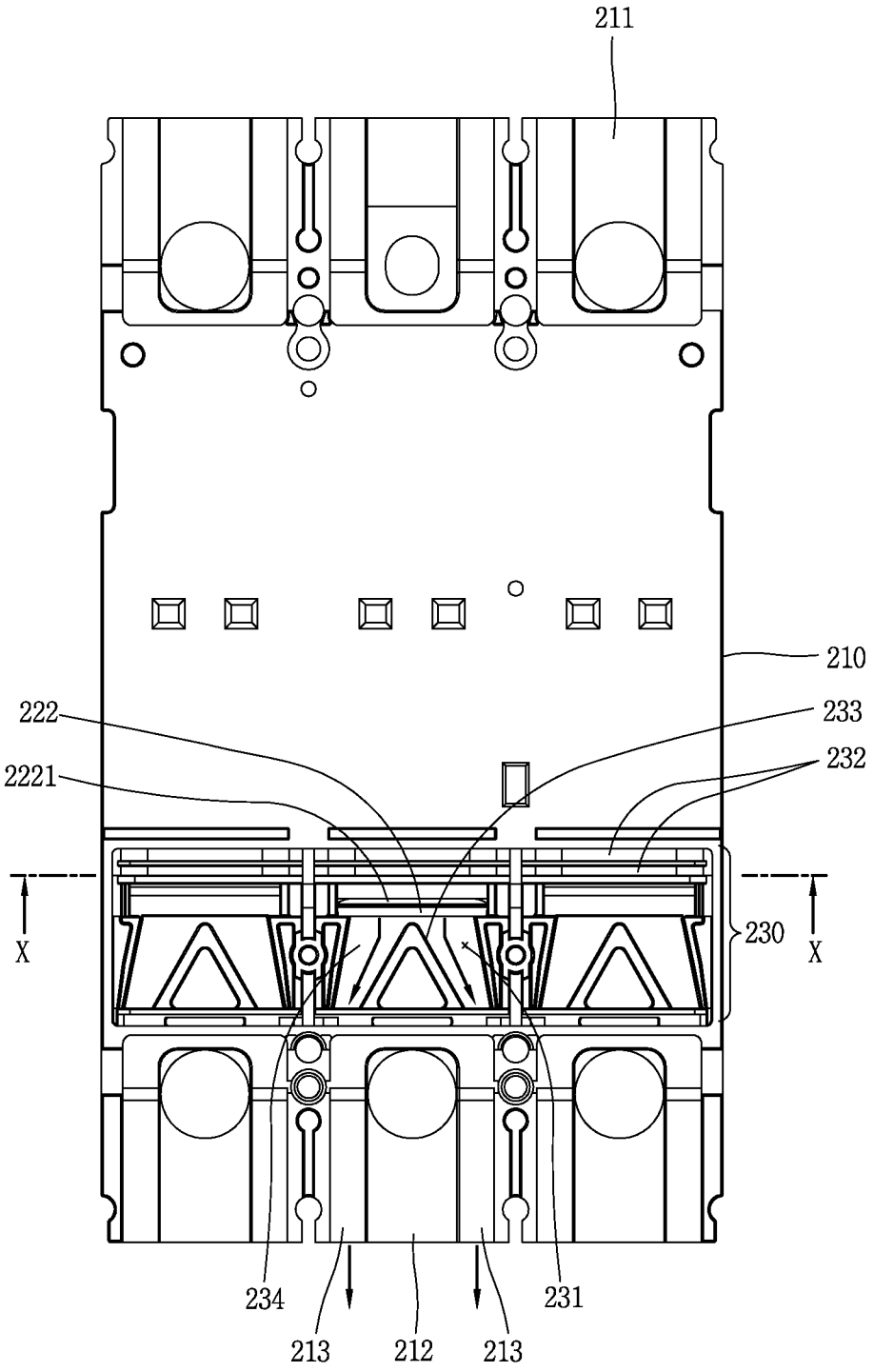
FIG. 6 is a bottom view of FIG. 5.
Figure 7:
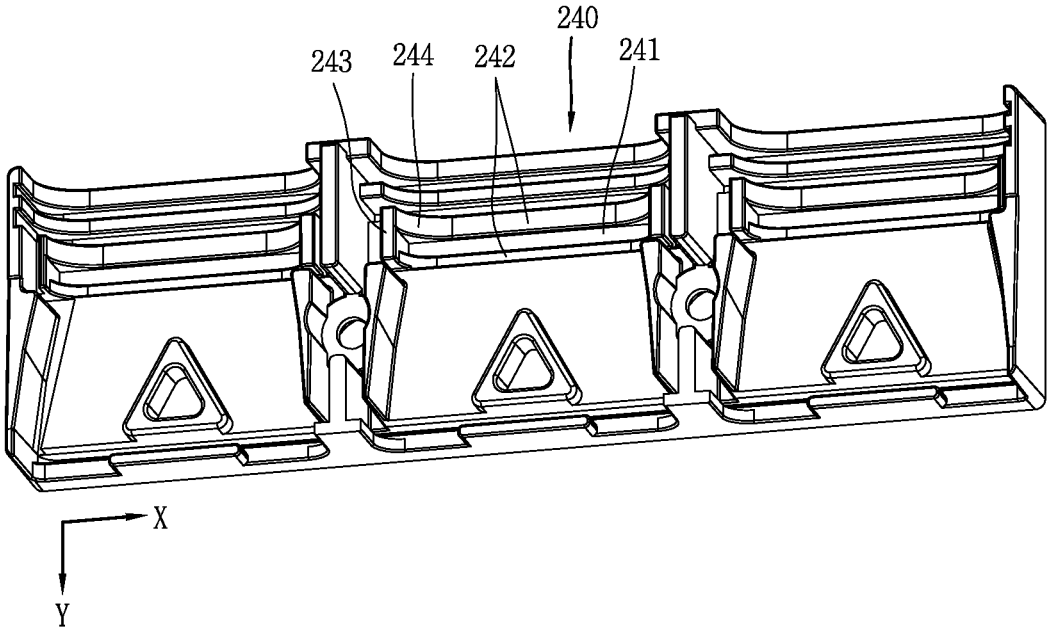
FIG. 7 is a perspective view illustrating an inner surface of the exhaust cover according to the exemplary embodiment.
Figure 8:
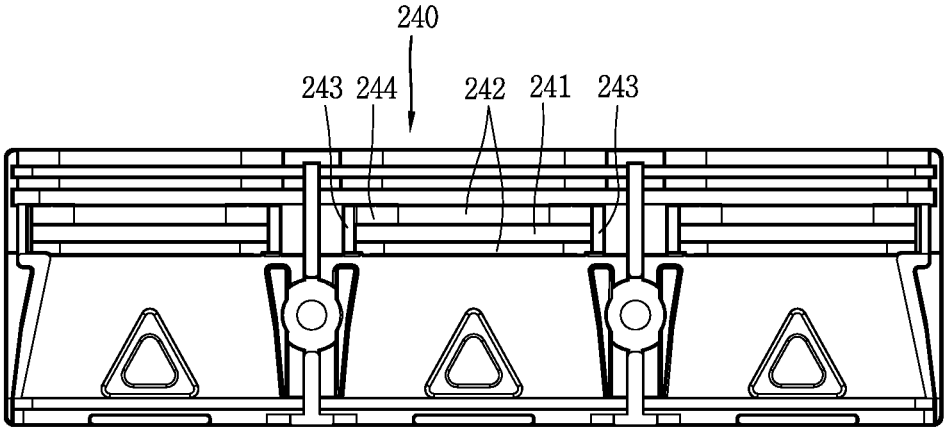
FIG. 8 is a plan view illustrating the inner surface of the exhaust cover in FIG. 7.

FIG. 5 is a bottom perspective view illustrating a state in which an exhaust cover is separated in FIG. 3. FIG. 6 is a bottom view of FIG. 5. FIG. 7 is a perspective view illustrating an inner surface of the exhaust cover according to the exemplary embodiment. FIG. 8 is a plan view illustrating the inner surface of the exhaust cover in FIG. 7.

The arc gas exhaust system may be configured with arc gas exhaust ports 222 provided in the housing 221, vent chutes 213 provided to the terminal part 212, and exhaust guide parts 230 disposed between the arc gas exhaust ports 222 and the vent chutes 213.

The arc gas exhaust ports 222 are respectively formed adjacent to the extinguishing parts 226 at both ends portions of the housing 221, so that an arc gas generated between contact points inside the interrupter assembly 220 can be exhausted to the exterior through the arc gas exhaust ports 222.

The power source side terminal part 211 or the load side terminal part 212 is a part to which an external power source side terminal or load side terminal is connected. The vent chutes 213 are respectively formed on both side surfaces of each terminal part 212 with the terminal part 212 interposed therebetween, to enable the arc gas to be exhausted to the exterior therethrough.

The trip part is mounted adjacent to the load side terminal part 212 inside the case 210. The trip part is disposed on the top of the exhaust guide part 230 to be described later. For example, the trip part performs a function of automatically separating a contact point in a short circuit between lines.

The exhaust guide parts 230 are respectively disposed between the internal spaces 214 in the middle of the case 210 and the terminal parts 212. Each exhaust guide part 230 has an exhaust chamber 231 disposed between the arc gas exhaust port 222 and the vent chute 213 to provide an arc gas passage.

The exhaust guide part 230 has a shield member disposed to be spaced apart in the height direction from the bottom surface of the lower case 210 contacted with the mounting surface of the MCCB, to divide the internal space of the case 210 and the exhaust chamber 231 into independent spaces separated from each other. The shield member 234 can completely prevent the arc gas exhausted to the exhaust chamber 231 from penetrating inside the case 210. In addition, the shield member 234 assists the arc gas to be quickly exhausted through the vent chute 213.

The shield member 234 is formed into a plate structure. One end portion of the shield member 234 is contacted with the load side terminal part 212, and the other end portion of the shield member 234 is horizontally extended toward the arc gas exhaust port 222 from the terminal part 212 to be contactable with the arc gas exhaust port 222.

An insertion part 232 having a "ㄷ" sectional shape is formed into a structure surrounding outer surfaces of the arc gas exhaust port 222 at one side (upstream side of the arc gas exhaust direction (Y)) of the exhaust guide part 230. For example, the arc gas exhaust port 222 has a quadrangular closed sectional shape. In this state, the insertion part 232 is formed to surround three adjacent surfaces of the "ㄷ" sectional shape among the outer surfaces of the arc gas exhaust port 222 and to communicate with the exhaust chamber 231. Accordingly, when the interrupter assembly 230 is inserted and assembled inside the case 210, the arc gas exhaust port 222 is inserted through the insertion part 232, so that the arc gas generated inside the interrupter assembly 220 can be exhausted to the exhaust chamber 231.

The exhaust guide part 230 has a triangular gas division part 233 which allows the arc gas 222 exhausted from the arc gas exhaust part 222 to be divided to both sides, and includes flow of the gas through the pair of vent chutes 213 disposed to be spaced apart from each other for each phase.

The gas division part 233 may be formed in a triangular at an end portion of the shield member 234.

The apex portion of the gas division part 233 may correspond to the center line of the arc gas exhaust port 222 in the width direction.

The apex portion of the gas division part 233 is disposed to be spaced apart from the end portion of the arc gas exhaust port 222 at a predetermined distance G in the arc gas exhaust direction, to minimize the flow resistance of the arc gas and quickly exhaust the arc gas.

In this state, the distance between the arc gas exhaust port 222 and the apex portion of the gas division part 233 is not particularly limited, but the arc gas exhaust port 222 and the apex portion of the gas division part 233 are preferably disposed at a distance from each other in order to minimize the flow resistance of the gas.

In this case, it has been confirmed through experiments that the flow resistance when there is a distance between the arc gas exhaust port 222 and the apex portion of the gas division part 233 is less than that when there is no distance between the arc gas exhaust port 222 and the apex portion of the gas division part 233.

The gas division parts 233 are disposed to be spaced apart from each other in separate spaces partitioned for the respective three phase power sources.

The exhaust guide part 230 has an opening in a surface opposite to the mounting surface of the MCCB.

The exhaust cover 240 is attachably/detachably mounted on the bottom surface of the case, to seal the opening of the exhaust guide part 230.

The exhaust path of the arc gas generated inside the interrupter assembly will be described. The arc gas has an independent arc gas exhaust path for each phase. That is, the arc gas is divided to both sides through the gas division part 233 via the exhaust chamber 231 in the arc gas exhaust port 222 and then exhausted to the exterior through the vent chute 213.

Here, the arc gas exhausted through the arc gas exhaust port 222 of the interrupter assembly 220 may be leaked through a gap between the interrupter assembly 220 and the exhaust cover 240, and therefore, it is necessary to seal the gap between the interrupter assembly 220 and the exhaust cover 240.

The arc gas exhaust port 222 of the interrupter assembly 220 is inserted and exposed into the exhaust chamber 231 through the insertion part 232 of the exhaust guide part 230, so that a gap may be formed between the exhaust cover 240 mounted on the bottom surface of the case 210 and the arc gas exhaust port 222.

In the present invention, a sealing projection 2221 is provided to block the gap described above.

Figure 9:
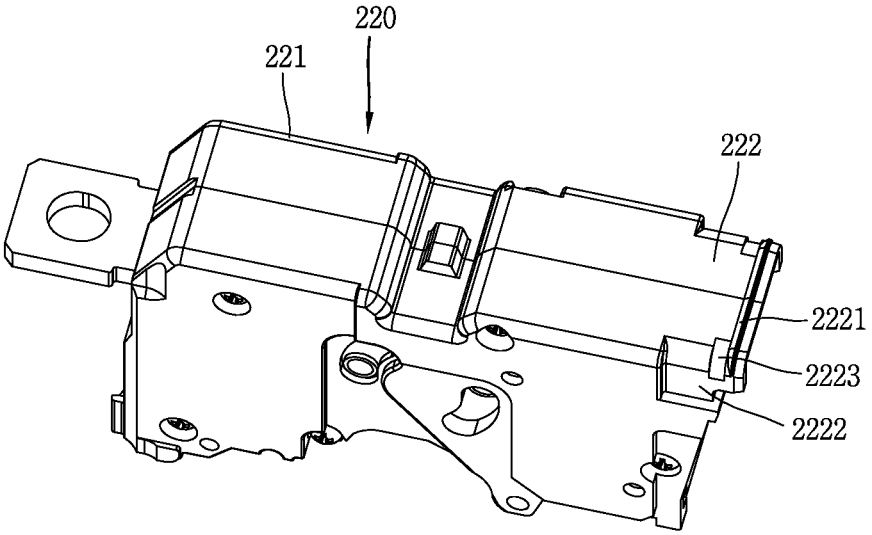
FIG. 9 is a bottom perspective view of the interrupter assembly in FIG. 2.
Figure 10:
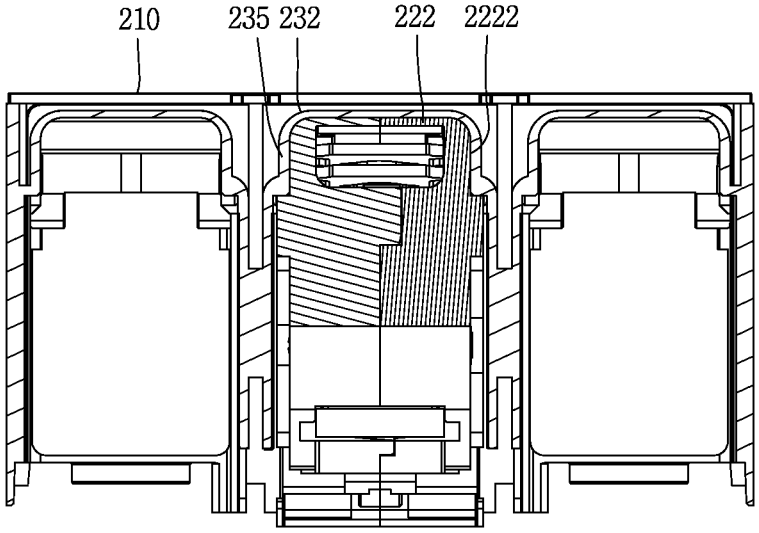
FIG. 10 is a sectional view taken along line X-X in FIG. 6.

FIG. 9 is a bottom perspective view of the interrupter assembly in FIG. 2. FIG. 10 is a sectional view taken along line X-X in FIG. 6.

The sealing projection 2221 is provided to the housing 221 of the interrupter assembly 220. The sealing projection 2221 is continuously extended long in the vertical direction (X) of the gas exhaust direction along the edge of a circumferential surface opposite to the exhaust cover 240 in the closed surface of the arc gas exhaust port 222. In this state, both corners of the arc gas exhaust port 222 are formed round, and the sealing projection 2221 may be formed throughout another corner from one corner in the circumferential surface of the arc gas exhaust port 222.

A sealing groove 241 is formed in an inner surface of the exhaust cover 240. The sealing groove 241 is a part into which the sealing projection 2221 is engageably inserted. Land parts 242 are respectively formed at both sides with the sealing groove 241 interposed therebetween. The land parts 242 are respectively overlapped with both side surfaces of the sealing projection 2221 when the sealing projection 2221 is inserted into the sealing groove 241.

In this state, the sealing projection 2221 is formed long in the vertical direction of the arc gas exhaust direction, which is effective to prevent leakage of the gas. Since the land parts 242 are respectively overlapped with both the side surfaces of the sealing projection 2221, the moving distance of the arc gas is extended, thereby maximizing the effect for preventing the leakage of the arc gas.

The land parts 242 are formed to be spaced apart from each other in the gas exhaust direction, and side protruding parts 243 are formed at both end portions of the land parts 242 to connect between the land parts 242. A coupling part 244 is formed round at a connecting portion between the side protruding part 243 and the land part 232.

In addition, coupling grooves 2223 are respectively formed round at both corner portions of the arc gas exhaust port 222. The coupling part 244 is inserted and coupled into the coupling groove 2223, so that the exhaust cover 240 and the arc gas exhaust port 222 are doubly overlapped. Accordingly, it is possible to double the effect for preventing the leakage of the arc gas.

The arc gas exhausted through the arc gas exhaust port 222 may penetrate into an internal gap of the case 210 from the exhaust chamber 240. That is, the arc gas may penetrate into a gap between the case 210 and the insertion part 232 into which the arc gas exhaust port 222 is inserted.

The present invention provides sealing maintenance grooves 2222 for preventing the arc gas from penetrating into the internal space of the case 210.

The sealing maintenance grooves 2222 are provided in the housing 221 of the interrupter assembly 220. Particularly, the sealing maintenance grooves are respectively recessed at both side surface of the arc gas exhaust port 222.

A sealing maintenance projection 235 is protruded to be engaged with the sealing maintenance groove 2222 on the inner surface of the insertion part 232 of the exhaust guide part 230, and the sealing maintenance projection 235 and the sealing maintenance groove 2222 come in surface contact with each other so that the contact area between the sealing maintenance projection 235 and the sealing maintenance groove 2222 is increased. Accordingly, it is possible to prevent the arc gas from penetrating into the gap between the housing 221 of the interrupter assembly 220 and the case 210.

Thus, according to the present invention, the arc gas exhausted through the arc gas exhaust port 222 of the interrupter assembly 220 is not leaked through a gap formed when the case 210 and the interrupter assembly 220 are coupled to each other, but can be quickly exhausted to the exterior.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A molded case circuit breaker, comprising:

a case configured to have a line side terminal part and a load side terminal part, to which a line side external terminal and a load side external terminal are respectively connected;

an interrupter assembly mounted inside the case, the interrupter assembly having an arc gas exhaust port to exhaust an arc gas generated inside the case;

an exhaust guide part disposed between the interrupter assembly and the terminal part, the exhaust guide part having an exhaust chamber therein to provide an arc gas passage between the arc gas exhaust port and a vent chute of the terminal part;

an exhaust cover mounted to the case in a structure covering the exhaust guide part, to seal the arc gas passage;

a sealing groove formed in an inner surface of the exhaust cover; and a sealing projection formed on the arc gas exhaust port of the interrupter assembly, to be inserted and coupled into the sealing groove, wherein the exhaust cover includes land parts formed in the inner surface of the exhaust cover, the land parts spaced apart from each other with the sealing groove interposed therebetween and overlapped with the sealing projection, wherein the interrupter assembly further includes coupling grooves respectively formed round at the corners along the circumferential surface of the arc gas exhaust port, and wherein the exhaust cover further includes:

side protruding parts protruding from both end portions of the land parts to connect the land parts; and a coupling part formed round at a connecting portion between the side protruding part and the land part to be coupled to the coupling groove while surrounding the coupling groove.

2. The molded case circuit breaker of claim 1, wherein the interrupter assembly includes:

a housing configured to have the arc gas exhaust port on at least one end thereof; and sealing maintenance grooves respectively formed adjacent to the are gas exhaust port at both side surfaces of the housing, and wherein a sealing maintenance projection is formed on an inner surface of the case, to be engageably coupled to the sealing maintenance groove.

3. The molded case circuit breaker of claim 1, wherein the sealing projection is formed opposite to the exhaust cover throughout another corner from one corner along the circumferential surface of the arc gas exhaust port.

* * * * *